US005937376A

United States Patent [19]

Minde

[11] Patent Number: 5,937,376

[45] **Date of Patent: *Aug. 10, 1999**

[54] METHOD OF CODING AN EXCITATION PULSE PARAMETER SEQUENCE

[75] Inventor: Tor Minde, Gammelstad, Sweden

[73] Assignee: Telefonaktiebolaget LM Ericsson, Stockholm, Sweden

[ * ] Notice: This patent is subject to a terminal disclaimer.

[21] Appl. No.: 08/930,952

[22] PCT Filed: Apr. 10, 1996

[86] PCT No.: PCT/SE96/00466

§ 371 Date: Oct. 10, 1997

§ 102(e) Date: Oct. 10, 1997

[87] PCT Pub. No.: WO96/32713

PCT Pub. Date: Oct. 17, 1996

[30] Foreign Application Priority Data

Apr. 12, 1995 [SE] Sweden ..... 9501368

[51] Int. Cl.[6] ..... G10L 3/02

[52] U.S. Cl. ..... 704/219; 704/220; 704/223

[58] Field of Search ..... 704/203, 204, 704/207, 209, 219, 220, 223, 262, 264; 370/213

[56] References Cited

U.S. PATENT DOCUMENTS

| | | |
|---|---|---|
| 3,624,302 | 11/1971 | Atal . |
| 3,740,476 | 6/1973 | Atal . |
| 4,472,832 | 9/1984 | Atal et al. . |
| 4,701,954 | 10/1987 | Atal . |
| 4,932,061 | 6/1990 | Kroon et al. . |
| 4,944,013 | 7/1990 | Gouvianakis et al. . |
| 5,193,140 | 3/1993 | Minde . |

FOREIGN PATENT DOCUMENTS 0 195 487 9/1986 European Pat. Off. ..... G01L 9/14

*Primary Examiner*—David R. Hudspeth
*Assistant Examiner*—Martin Lerner
*Attorney, Agent, or Firm*—Burns, Doane, Swecker & Mathis, L.L.P.

[57] ABSTRACT

The excitation pulse parameters are encoded when determining the positions of a given number of excitation pulses within a speech frame in a linear predictive speech encoder. The positions are determined by a combination of two known methods. First, a plurality of calculation stages are performed to determine the positions of the excitation pulses in accordance with the first known method. Then, a plurality of calculation stages are performed to determine the positions of the excitation pulses in accordance with the second method, each with a starting point from one of a plurality of positions calculated in accordance with the first method.

3 Claims, 8 Drawing Sheets

P1
P2
P3
P4
n

S1
S2
S3
S4
n
t1
t2
t3
t4 n
1
1 n
1
1
1

1
1
1
n

METHOD OF CODING AN EXCITATION PULSE PARAMETER SEQUENCE

TECHNICAL FIELD

The present invention relates to a method of coding an excitation pulse parameter sequence in a speech frame in a linear predictive speech encoder which operates in accordance with the multiple pulse principle. Such a speech encoder may be used in a mobile telephone system for instance, to compress the speech signals prior to their transmission from a mobile station.

Linear predictive speech encoders which operate in accordance with the aforesaid multipulse principle are known to the art; see, for instance, U.S. Pat. No. 3,624,302 which describes linear predictive encoding of speech signals, and U.S. Pat. No. 3,740,476 which describes how predictive parameters and prediction residual signals can be formed in such a speech encoder.

When forming an artificial speech signal by means of linear predictive coding, there are generated from the original signal a plurality of predictive parameters ($a_k$) which characterize the artificial speech signal. Thus, there can be formed from these parameters a speech signal which does not contain the redundancy that is normally included in natural speech and which it is unnecessary to convert in speech transmission between, e.g., a mobile and a base station in a mobile radio system. From the aspect of bandwidth, it is more suitable to transmit solely the predictive parameters instead of the original speech signal, which requires a much higher bandwidth. However, the speech signal thus regenerated in a receiver and constituting a synthetic speech signal may be difficult to understand as a result of a lack of agreement between the speech pattern of the original signal and the synthetic signal regenerated by means of the predictive parameters. These deficiencies have been described in detail in U.S. Pat. No. 4,472,832 (SE-B-456618) and can be alleviated to some extent by introducing so-called excitation pulses (multipulses) when constructing the synthetic speech replica. This is effected by partitioning the original speech input pattern into frame intervals. There is formed within each such interval a determined number of pulses of varying amplitude and phase position (time position) in accordance with the predictive parameters $a_k$ and also in accordance with the prediction residual $d_k$ between the speech input pattern and the speech replica. Each of the pulses is able to influence the speech pattern replica such as to obtain the smallest possible prediction residual. The generated excitation pulses have a relatively low bit rate and can therefore be encoded and transmitted on a narrow band, similar to the predictive parameters. This improves the quality of the regenerated speech signal.

In the aforesaid known method, the excitation pulses are generated within each frame interval of the speech input pattern by weighting the residual signal $d_k$ and feeding back and weighting the generated values for the excitation pulses each in a predictive filter. A correlation is then effected between the output signals on the two filters and the correlation is maximized for a number of signal elements from the correlated signal, such as to form the parameters (amplitude and phase position) of the excitation pulses. The advantage afforded by this multipulse algorithm for generating the excitation pulses is that different types of sound can be generated with a small number of pulses (for instance eight pulses/frame interval). The pulse-searching algorithm is general with respect to the pulse positions within the frame. It is possible to regenerate unvoiced sounds (consonants), which generally require randomly placed pulses and voiced sounds (vowels) which require positioning of pulses to be more correlated.

These known methods calculate the correct phase positions of the excitation pulses within a frame and subsequent frames of the speech signal and positioning of the pulses, so-called pulse placement, is effected solely in dependence on complex processing of the speech signal parameters (prediction residuals, residual signal and the excitation pulse parameters in preceding frames).

One drawback with the original pulse placement methods according to the aforesaid U.S. patent is that encoding, which is effected subsequent to calculating the pulse positions, is complex with regard to calculations and storage. The encoding also requires a large number of bits with each pulse position within the frame interval. Furthermore, the bits in the code words obtained from the optimal combinatory pulse encoding algorithms are sensitive to bit errors. A bit error in the code word during transmission from the transmitter to the receiver can have disastrous consequences with regard to pulse positioning when decoding in the receiver.

This can be alleviated by restricting the number of excitation pulses that need be set out in each speech frame. This is made possible by the fact that the number of pulse positions for the excitation pulses within a frame interval is so large as to enable precise positioning of one or more excitation pulses within the frame to be ignored while nevertheless obtaining a regenerated speech signal of acceptable quality after encoding and transmission.

Accordingly, there has been proposed a method (see U.S. Pat. No. 5,193,140) in which certain phase position limitations are introduced when setting out the pulses, by prohibiting a certain number of phase positions that have already been determined to those pulses which succeed the phase position of an already calculated excitation pulse. When the position of a first pulse in the frame has been calculated and placed in its calculated phase position, this phase position is denied to subsequent pulses in the frame. This rule will preferably apply to all pulse positions in the frame. When commencing the localization of pulses in a new following frame, all positions in the frame are free.

The use of so-called code books in speech encoders when generating the synthetic speech signal has been proposed in recent times; see, for instance, U.S. Pat. No. 4,701,954. This code book stores a number of speech signal code words that are used when creating the synthetic speech replica. The code book may be fixed, i.e. contain permanent code words, or may be adaptive, i.e. can be updated as the speech replica is formed. A combination of a fixed and an adaptive code book may also be used.

SUMMARY

The aforesaid method of prohibiting all phase positions within a speech frame where one position has already been allocated an excitation pulse results in a more limited number of transferred excitation pulses than when only one restriction is used. In addition, it is easier to encode the phase positions of the excitation pulses on the transmitter side, while improving the separation of phase positions when decoding on the receiver side.

According to the present invention, the most sensible phase positions are coded individually while the less sensible phases are commonly coded.

The proposed method can be applied in a speech encoder that operates in accordance with the multipulse principle with correlation of an original speech signal and the impulse response of an LPC synthesized signal, with or without the use of code books in accordance with the aforegoing. However, the method can also be applied with a so-called RPE speech encoder in which several excitation pulses are set out simultaneously in the frame interval.

BRIEF DESCRIPTION OF THE DRAWINGS

The proposed method will now be described in more detail with reference to the accompanying drawings, in which.

DETAILED DESCRIPTION

Figure 1:
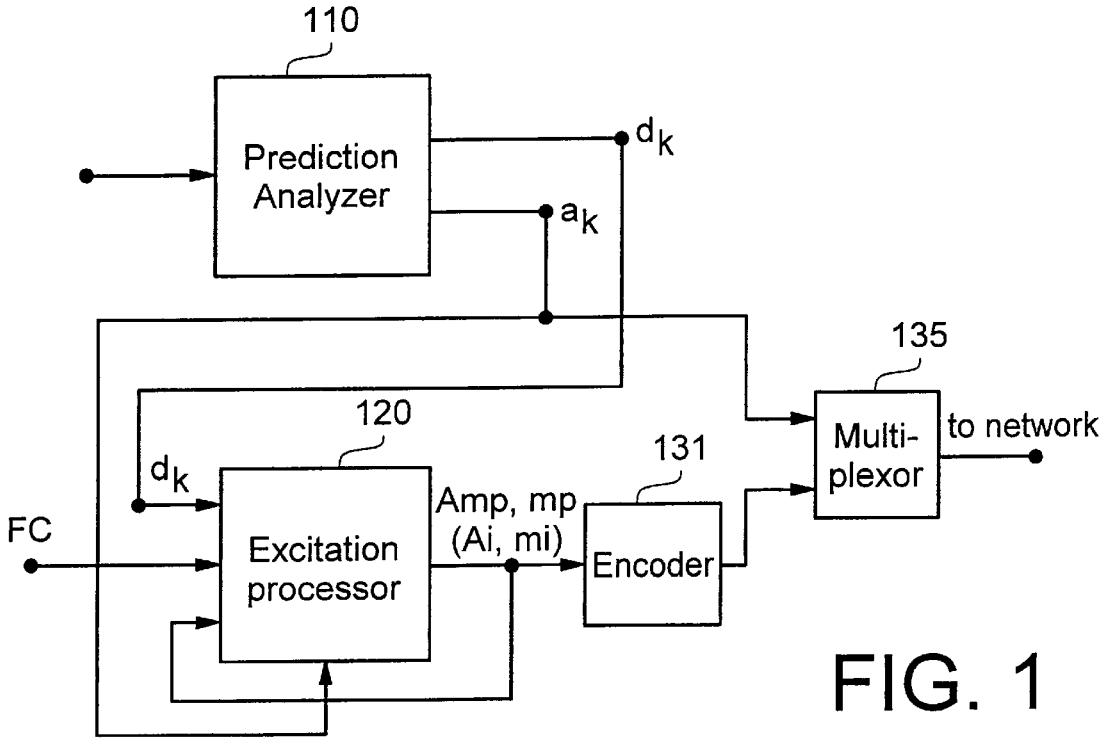
FIG. 1 PRIOR ART
FIG. 1 is a simplified block schematic illustrating a known LPC speech encoder.

FIG. 1 is a simplified block schematic which illustrates a known LPC speech encoder according to the multipulse principle with correlation. Such an encoder is described in detail in U.S. Pat. No. 4,472,832 (SE-B-456618). An analogue speech signal from a microphone, for instance, appears on the input of a prediction analyzer 110. In addition to an analog-digital converter, the prediction analyzer 110 also includes an LPC computor and a residual signal generator, which form predictive parameters $a_k$ and a residual signal $d_k$. The predictive parameters characterize the synthesized signal and the original speech signal across the analyzer input.

An excitation processor 120 receives the two signals $a_k$ and $d_k$ and operates during one of a number of mutually sequential frame intervals determined by the frame signal FC, so as to produce a certain number of excitation pulses during each interval. Each pulse is therewith determined by its amplitude $A_{mp}$ and its time position $m_p$ within the frame. The excitation pulse parameters $A_{mp}$, $m_p$ are led to an encoder 131 and thereafter multiplexed with the predictive parameters $a_k$ prior to transmission from a radio transmitter, for instance.

The excitation processor 120 includes two predictive filters which have the same impulse response for weighting the signals $d_k$ and ($A_i$, $m_i$) in accordance with the predictive parameters $a_k$ during a given calculation or arithmetical stage p. Also included is a correlation signal generator which effects correlation between the weighted original signal (y) and the weighted artificial signal ($\hat{y}$) each time an excitation pulse is to be generated. A number of pulse element candidates $A_i$, $m_i$ ($0 \leqq i < I$) are obtained for each correlation, of which candidates one (1) gives the least square error or the smallest absolute value. The amplitude $A_{mp}$ and the time position $m_p$ for the selected candidate are calculated in the excitation signal generator. The contribution from the selected pulse $A_{mp}$, $m_p$ is then subtracted from the desired signal in the correlation signal generator, such as to obtain a new sequence of candidates. The procedure is then repeated a number of times equal to the desired number of excitation pulses within a frame. This is described in detail in the aforesaid U.S. patent specification.

Figure 2:
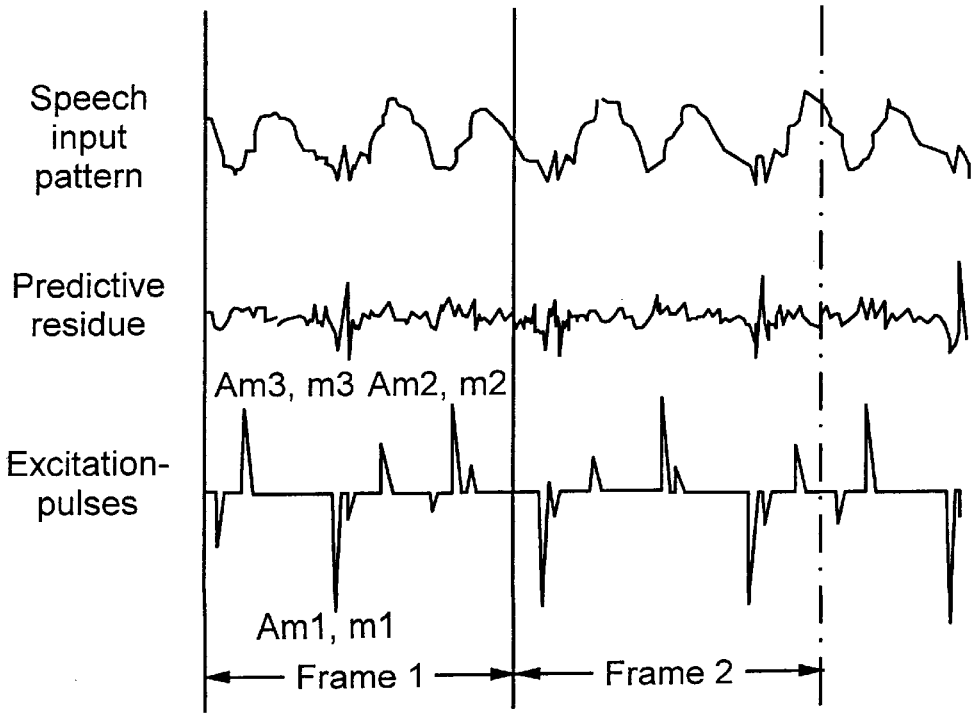
FIG. 2 PRIOR ART
FIG. 2 is a time diagram showing certain signals that appear in the speech encoder of FIG. 1.

FIG. 2 is a time diagram of speech input signals, predictive residual signals $d_k$ and excitation pulses. In the illustrated case, the excitation pulses are eight in number, of which the pulse $A_{m1}$, $m_1$ was first selected (gave the smallest error), and thereafter $A_{m2}$, $m_2$, and so on throughout the frame.

In the earlier known method for calculating amplitude $A_{mp}$ and phase position $m_p$ for each excitation pulse from a number of candidates $A_i$, $m_i$, $m_p = m_i$ is calculated for the candidate i which gave the maximum value of $\alpha_i/\Phi_{ij}$ and the associated amplitude $A_{mp}$ is calculated, where $\alpha_i$ is the cross-correlation vector between the signals $y_n$ and the $\hat{y}_n$ in accordance with the aforegoing, and $\Phi_{ij}$ (hereinafter called $C_{ij}$, i=j=m) is the autocorrelation matrix for the impulse response of the predictive filters. Any position $m_p$ whatsoever is accepted when only the aforesaid conditions are to be fulfilled. Index p denotes the stage during which an excitation pulse is calculated in accordance with the aforegoing.

Figure 3:
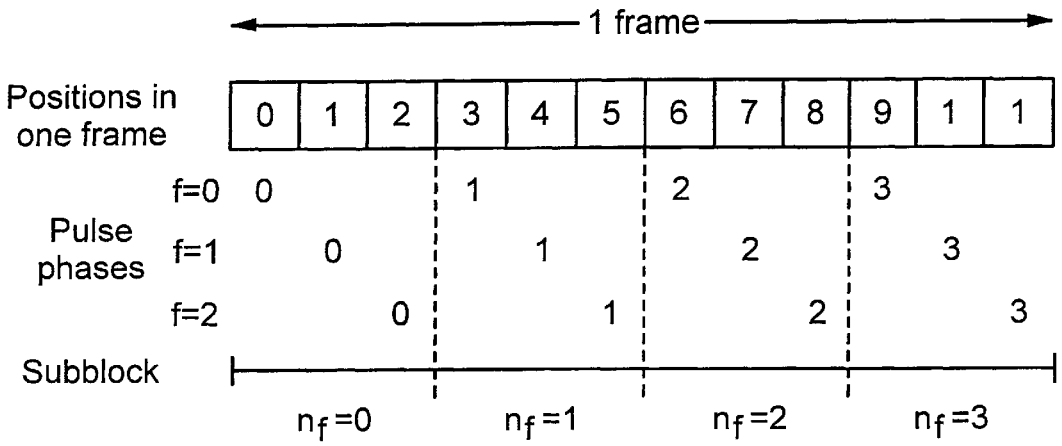
FIG. 3 PRIOR ART
FIG. 3 illustrates schematically a speech frame which is intended to explain the principle of the earlier known method involving restrictions when determining the excitation pulses.

According to the earlier known method in which determination of the positions of the excitation pulses is restricted, a frame according to FIG. 2 is partitioned as illustrated in FIG. 3. It is assumed by way of example that the frame contains N=12 positions. The N positions therewith form a search vector (n). The entire frame is divided into so-called subblocks. Each subblock will then include a certain number of phases. For instance, if the frame as a whole includes N=12 positions, as shown in FIG. 3, four subblocks are obtained with three different phases within each subblock. The subblock has a given position within the frame as a whole, this position being referred to as the phase position. Each position n ($0 \leqq n < N$) will then belong to a certain subblock $n_f$ ($0 \leqq n_f < N_f$) and a certain position f ($0 \leqq f \leqq F$) in said subblock.

The following relationship generally applies to the positions n ($0 \leqq n \leqq N$) positions in the total search vector containing N positions:

$$n = n_f F + f \tag{1}$$

where f=the pulse phase within a subblock nf and F=the number of phases within the block nf.

$$n_f = 0, \ldots, (N_f - 1),\ f = 0, \ldots (F-1) \text{ and } n = 0, \ldots, (n-1).$$

The following relationship also applies:

$$f_p = n \text{ MOD F and } n_{fp} = n \text{ DIV F} \tag{1}.$$

FIG. 3 is a schematic illustration of the distribution of the phases fp and subblock $n_{fp}$ for a certain search vector containing N positions. In this case, N=12, F=3 and $N_F$=4.

In the known method which employs restrictions, the pulse search is restricted to positions that do not belong to an already accommodated phase $f_p$ for those excitation pulses whose positions n have been calculated in preceding stages.

The sequence number of a given excitation pulse calculating cycle will be referenced p in the following, in accordance with the aforegoing. The known method which includes restrictions then provides the following calculating procedure for a frame interval:

1. Calculate the desired signal yn.
2. Calculate the cross-correlation vector $\alpha_i$ and copy to asave(i).
3. Calculate the autocorrelation matrix $C_{ij}$ ($=\Phi_{ij}$ i=j=m).
4. For p=1. Search for the pulse position, i.e. $m_p$, that gives maximum $\alpha_1/C_{ij}$ in unoccupied phases f.
5. Calculate the amplitude $A_{mp}$ for the discovered pulse position $m_p$.
6. Update the cross-correlation vector $\alpha_i$.
7. Calculate $f_p$ and $n_{fp}$ in accordance with the above relationship (1).
8. For p=p+1 execute the same steps 4–7.

The flow chart, which illustrates the known method more clearly, is shown in FIGS. 6*a* and 6*b* of the aforesaid U.S. Pat. No. 5,193,140.

The obtained phases $f_1, \ldots, f_p$ are coded together and the phase positions (the subblocks) $n_{f1}, \ldots, n_{fp}$, are each encoded individually prior to transmission. Combinatory coding can be used for encoding the phases. Each of the phase positions is encoded with code words individually.

Figure 4:
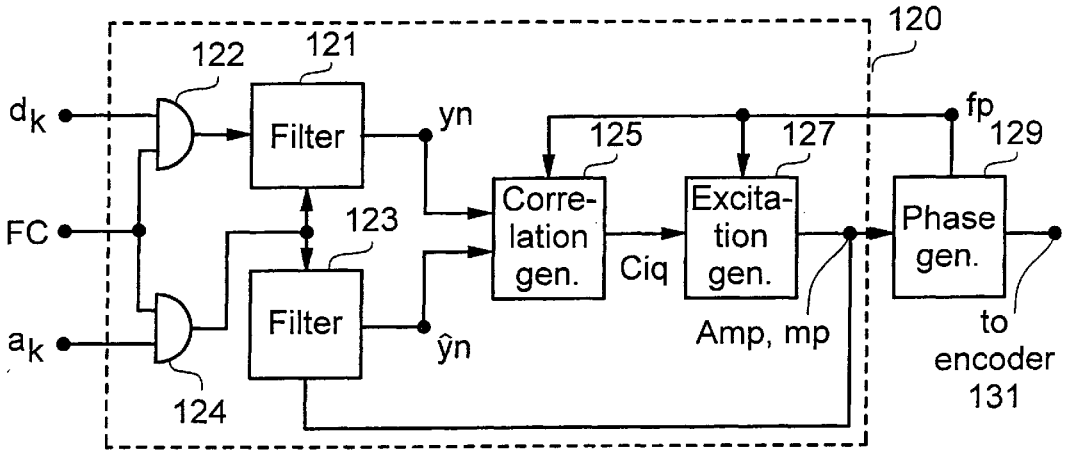
FIG. 4 PRIOR ART
FIG. 4 is a block schematic illustrating part of a speech encoder that operates in accordance with the principle of the invention.

In one embodiment, the known speech process circuit that has no restrictions with regard to placement of the pulses may be modified in the manner shown in FIG. 4, which illustrates that part of the speech processor which includes the excitation signal generating circuits 120.

The predictive residual signal $d_k$ and the excitation generator 127 are each applied to a respective filter 121 and 123 in time with a frame signal FC, through the medium of gates 122, 124. The signals $y_n$ and $\hat{y}_n$ obtained from the respective filters 121, 123 are correlated in the correlation generator 125. The signal $y_n$ represents the true speech signal while $\hat{y}_n$ represents the artificial speech signal. There is obtained from the correlation generator 125 a signal $C_{iq}$ which contains the components $\alpha_i$ and $\Phi_{ij}$ in accordance with the above. The pulse position $m_p$ which provides maximum $\alpha_i/\Phi_{ij}$ is calculated in the excitation generator 127, wherewith the amplitude $A_{mp}$ can also be obtained in addition to said pulse position $m_p$ in accordance with the above.

The excitation pulse parameters $m_p$, $A_{mp}$ are delivered from the excitation generator 127 to a phase generator 129. This generator calculates the relevant phases $f_p$ and the phase positions (subblocks) $n_{fp}$ from the values $m_p$, $A_{mp}$ incoming from the excitation generator 127, in accordance with the relationship $$f=(m-1) \text{ MOD } F$$

$$n_f=(m-1) \text{ DIV } F$$

where F=the number of possible phases.

The phase generator 129 may comprise a processor which includes a read memory that stores instructions for calculating the phases and the phase positions in accordance with the above relationship.

The phase $f_p$ and the phase position $n_{fp}$ are then delivered to the encoder 131, FIG. 1. This encoder has the same principle construction as the known encoder but codes phase and phase position instead of pulse positions $m_p$. The phase and phase position are decoded on the receiver side and the decoder then calculates the pulse position $m_p$ in accordance with $$m_p=(n_{fp}-1)F+f_p$$

therewith clearly determining the excitation pulse location.

The phase $f_p$ is also delivered to the correlation generator 125 and to the excitation generator 127. The correlation generator stores this phase while observing that this phase $f_p$ is occupied. No values of the signal $C_{iq}$ are calculated when q is included in those positions that belong to all preceding $f_p$ calculated for an analyzed sequence. The occupied positions are $$q=nF+f_p$$

where $n=0, \ldots, (N_f-1)$ and $f_p$ represent all preceding phases within an occupied frame. Similarly, the excitation generator 127 observes the occupied phases when comparing between signals $C_{iq}$ and $C_{iq}{}^*$.

When all pulse placements for a frame have been calculated and carried out and the next frame is to be commenced, all phases will naturally again be free for the first pulse in the new frame.

Figure 5:
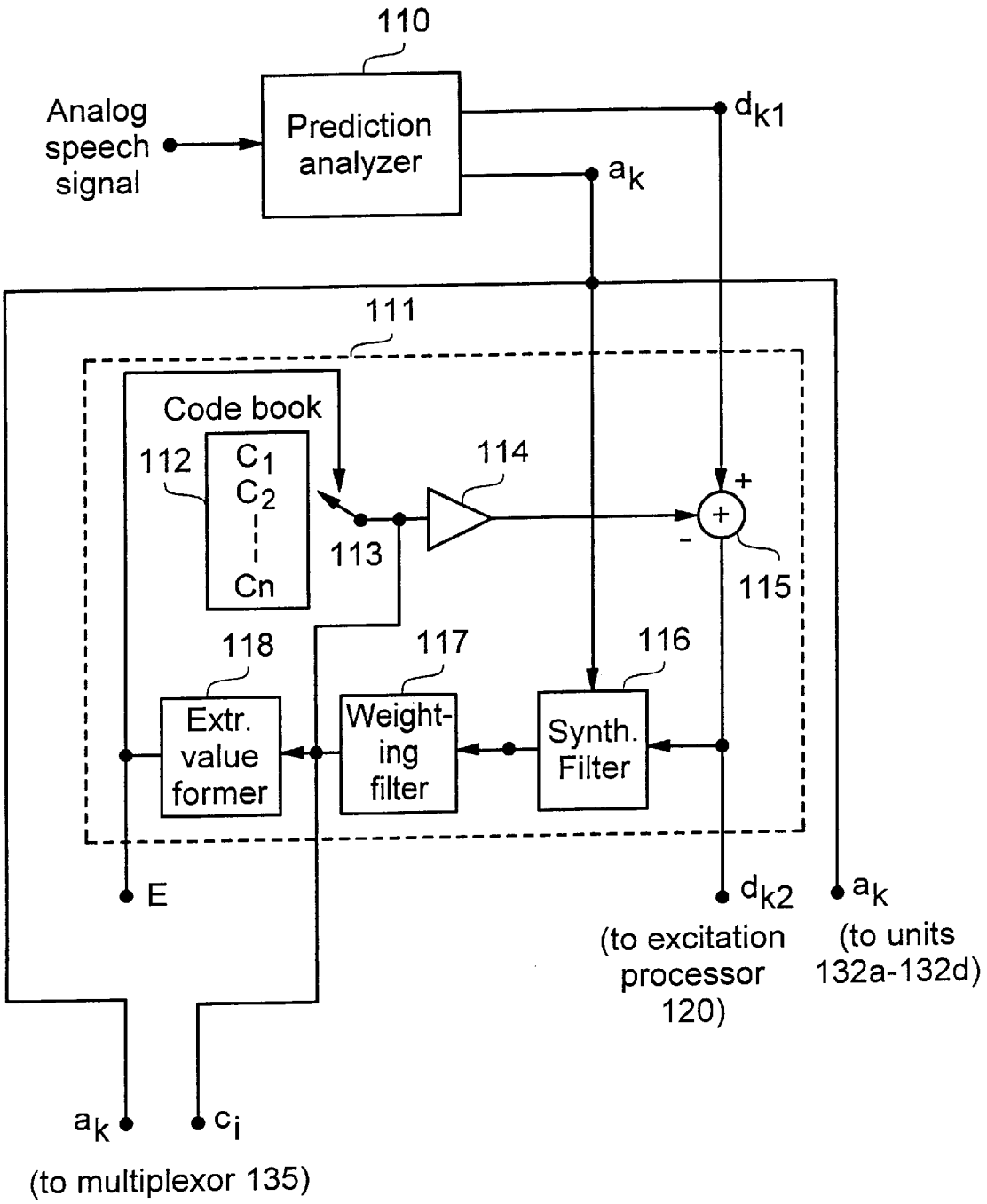
FIG. 5 is a block schematic illustrating part of a known speech encoder having an adaptive code book in which the method according to the invention can be applied.

FIG. 5 illustrates another type of speech encoding routine effected with the aid of a so-called adaptive code book. The prediction analyzer 110 produces the two parameters ak and dk, these parameters being used as input magnitudes to a block referenced 111 introduced prior to the excitation processor 120 in FIG. 4.

The block 111 contains an adaptive code book 112 which stores a number of code words c1, . . . cn and which can be updated by a control signal. This is symbolized in FIG. 5 by means of a selector 113 which points to a given code word $c_i$ in accordance with the value of the control signal. The code word is scaled from the code book 112 by a scale unit 114 in a suitable manner, and the scaled code word is delivered to the minus input of a summator 115 whose plus input receives the predictive residue dk from the analyzer 110. In the illustrated case, the predictive residue delivered to the summator 115 is referenced dk1 and the residue obtained downstream of the summator 115 is referenced dk2. The predictive parameters ak (unchanged from the analyzer 110) and the new prediction residue dk2 are applied to the excitation processor 120 in accordance with FIG. 4.

The control signal to the selector 113 is derived from a loop which includes an adaptive filter 116 having the filter parameters ak, a weighting filter 117 and an extreme value former 118. The residual signal dk2 is delivered to the filter 116 and the filtered signal is weighted in the filter 117.

A first selected code word gives a predictive residue dk2 which is filtered and weighted in the filters 116, 117 and the least square error E is formed in the extreme value former 118. The above procedure is carried out for all selected code words and, after being scaled in scaler 114, that code word which gave the smallest error is subtracted from the residual signal $d_{k1}$ to give a new residual signal $d_{k2}$. This is so-called closed loop searching for the best code word when using an adaptive code book. The circuit shown in FIG. 5 can thus either be used or not used when carrying out the inventive method. This improves the value of the prediction residue $d_k$ according to FIG. 1. Thus, in FIG. 4

$d_k=d_{k1}$ when an adaptive code book is not used; and $d_k=d_{k2}$ when an adaptive code book is used.

As will be described below with reference to FIG. 9, the circuit shown in FIG. 5 is also used in certain blocks (132*a–d*) to search for the error "closed loop", although in this case the code book is replaced with a memory space for storing solely a pulse placement calculated with restrictions.

The predictive parameters $a_k$ and index i for the selected code word $c_i$ (smallest error) are supplied to the multiplexor 135 and transmitted in a known manner.

The method according to the invention will now be described in more detail with reference to FIG. 6.

At the start of a pulse placement routine, there is first determined a number j of excitation pulses by means of the known method without restrictions, block 1. These are calculated in a known manner, as described above. Both the pulse positions and mp ($1 \leqq p \leqq j$) and the amplitudes Amp within the frame are determined in this way. It is not necessary to use the amplitude Amp of these pulses when determining with restrictions, since each of the pulse positions calculated in accordance with the aforegoing is used thereafter and the amplitude is therewith of no interest. However, it is necessary to also use the amplitudes in an alternative method with phase adjustment of the start pulses unless the amplitudes are recalculated.

When the number j of pulse positions mp (p=1, . . . , j) has been determined in this way, calculation of excitation pulses is commenced in accordance with the known method with restrictions, block 2. Both pulse position mp and the amplitude Amp of each excitation pulse is determined in accordance with the known method described above. The procedure thus commences with a starting point from the position mi ($1 \leqq i \leqq j$) of a selected excitation pulse that has been determined in accordance with block 1 (without restrictions) within the same frame. Calculation of the new excitation pulses (with restrictions in accordance with the known method) is effected for a given number, N1.

Figure 6:
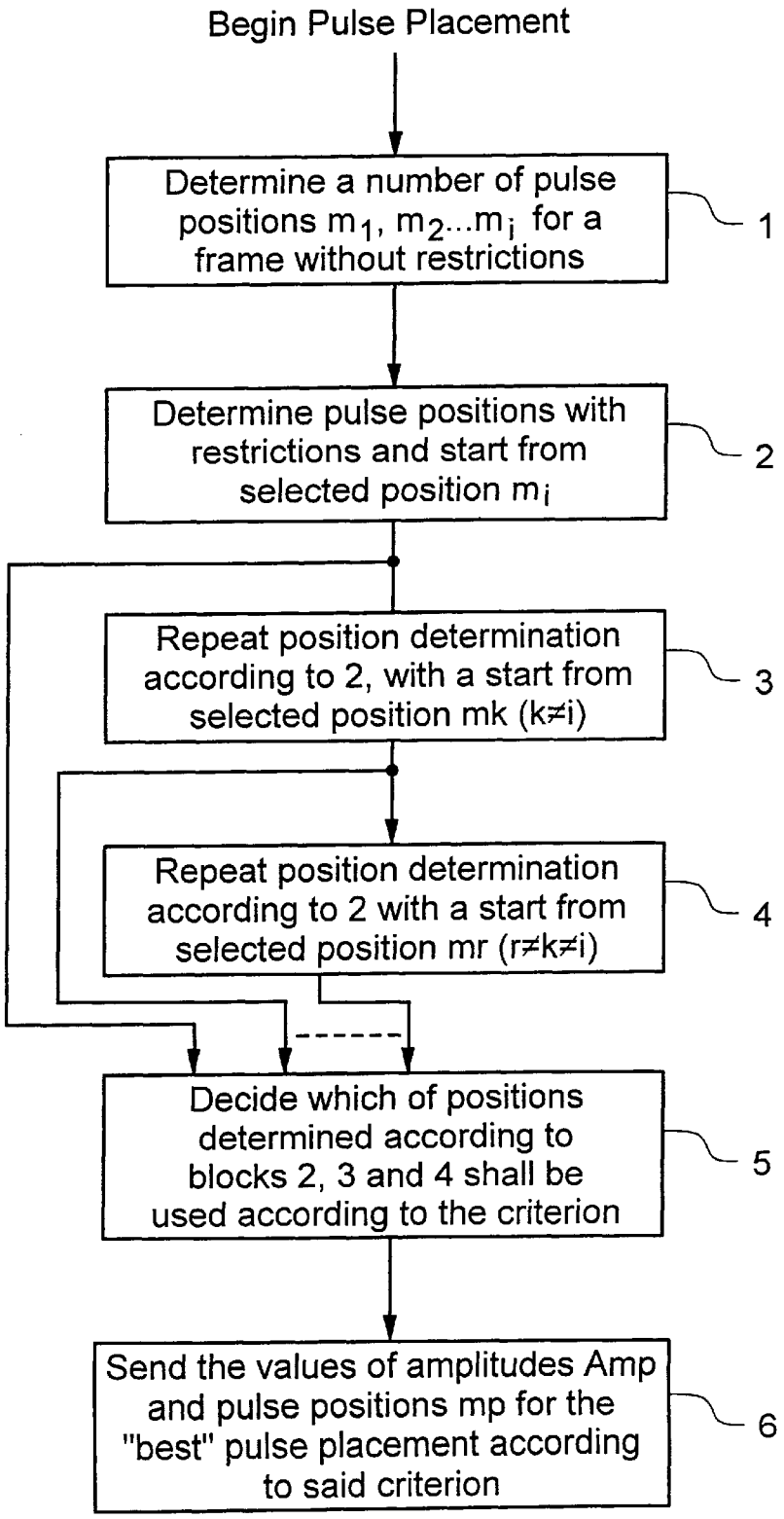
FIG. 6 is a flow chart for explaining the inventive method.

Subsequent to this first calculating stage with restrictions (block 2), the position mk (k=i) for a new excitation pulse is calculated in accordance with the known method without restrictions (block 1), whereafter the same calculation routine with restrictions as that mentioned above for the first calculation stage is also carried out for this second calculation stage, block 3 in FIG. 6, although now with a start from another position mk ($1 \leqq k \leqq j$; k=1). The calculation is performed for a given number N2 of excitation pulses, where N2 may be equal to N1, however.

The calculation stages carried out by means of the known method with restrictions are then continued for a number of times up to the last stage, block 4 in FIG. 6. The number L of such stages need not be equal to the number of positions j=P for the excitation pulses obtained in accordance with the method without restrictions (block 1). It may be suitable to interrupt the procedure subsequent to having carried out a small number of stages if the speech quality is found acceptable, resulting in fewer calculations. It may also be appropriate to improve accuracy by providing more start positions than the original number of positions P for the excitation pulses calculated without restrictions. The resultant number of positions will then be L=P+Pextra, where Pextra denotes the extra positions. This will be described in more detail with reference to FIG. 7.

The aforementioned resultant pulse positions L=P+Pextra can be used to place further restrictions on those pulses that shall be permitted, and therewith reduce the complexity of the subsequent pulse searches with restrictions. It is thus also possible to prohibit those phases fp (p=1, . . . , j) which lie furthest away from taking those pulse positions that have been calculated without restrictions.

According to FIG. 6, the pulse placement routine according to the method with restrictions is interrupted after a given number of stages (N1 stages with a start from pulse p1, N2 stages with a start from pulse p2, etc.). This will result in L number of pulse placements from each of the originally calculated positions (without restrictions) including any extra positions Pextra. It is then decided, block 5, which of the L pulse placements shall be used in accordance with a given criterion. The pulse placement that best fulfils the criterion is retained and the others discarded. The manner in which this criterion, so-called closed loop, is formed will be explained below in more detail with reference to the block schematic of FIG. 9, which shows the case L=4.

The thus chosen pulse placement (Amp, mp, p=1, 2, . . . , i, k, r) with restrictions positions the final excitation pulses in the frame and corresponds to the values of phase positions and phase position locations sent to the receiver. Those positions (mp, p=1, . . . , j) which have been calculated initially without restrictions are not transmitted.

An algorithm for the calculating stages according to the aforegoing is shown in Appendix 1.

Figure 7:
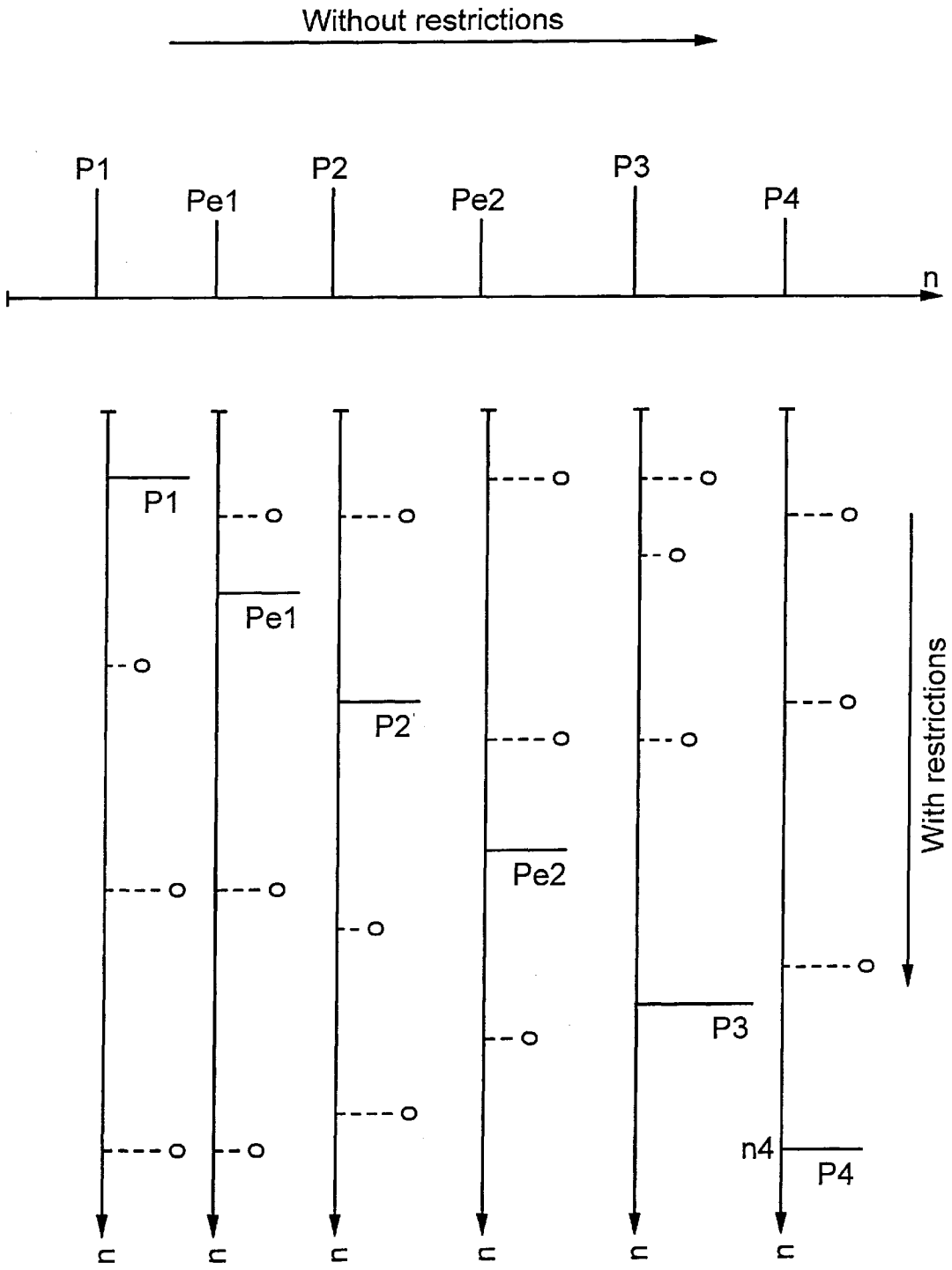
FIG. 7 is a diagram which illustrates the placement or setting-out of pulses in accordance with the invention.

FIG. 7 is a diagrammatic illustration of excitation pulses and extra pulses calculated without restrictions and those pulse placements that are calculated with restrictions. The pulses P1, P2, P3 and P4 are those excitation pulses that have been calculated in accordance with the earlier known method (block 1, FIG. 6). These pulses have phase positions n1, n2, n3 and n4 respectively. In addition to these pulses, a further two pulse positions Pe1 and Pe2 with phase positions n5 and n6 are calculated in accordance with the same known method in the illustrated case. Thus, the phase positions n1–n6 provide the start positions for calculating a number of L=6 pulse placements calculated in accordance with the known method with restrictions (blocks 2–4, FIG. 6). There are thus obtained two "extra" pulse placements which can be included when testing for the "best" pulse placement in accordance with the aforesaid criterion. In FIG. 7, the start pulse in respective pulse placements has been marked with a thick full line and a square, while the calculated pulses in respective pulse placements are marked with broken lines and a ring.

The different pulse placements calculated with restrictions and belonging to all start pulses P1–P4 and extra pulses Pe1, Pe2 are then tested in accordance with the closed loop criterion. The pulse placement that was found to be "best", i.e. the placement that had the smallest error is selected and transferred. Remaining pulse placements are not used for this particular frame.

As an alternative to the aforedescribed calculation of the positions of the excitation pulses, it is possible to adjust the phases of the excitation pulses calculated without restrictions while taking the restrictions into consideration. In this case, the phases fp are chosen for the pulse placement that was found to be the best according to said criterion.

For each start pulse of the total number of calculated start pulses without restrictions in a frame, there is defined a search area which is comprised of a time interval of specified magnitude around the position of the start pulse in the frame. There is then calculated on the basis of each of the start pulses a pulse placement with the restriction that none of the positions of the calculated pulses may lie outside the search area. In this way, there is obtained in addition to the position of the start pulse concerned also a small number of positions for those pulses that lie within the search area for the remaining start pulses. This procedure is repeated for each of the remaining start pulses and results in a number of pulse placements where one pulse in each placement will always correspond to the exact position of respective start pulses and where the positions of remaining pulses lie within respective search areas for remaining start pulses.

In addition to the aforesaid pulse placement restrictions, further restrictions are placed on the coding of the different pulse positions mp obtained. This condition is applied to the different positions tested in accordance with the aforegoing prior to carrying out the closed loop test. The code restriction means that certain so-called encodable vectors are selected where each vector corresponds to a pulse placement calculated with restrictions in accordance with the aforegoing.

The positions n ($0 \leqq n \leqq N$) in the total search vector which contains N positions will generally be $$n=n_f F+F; \text{ where}$$

f=the phase within a subblock (phase position) nf and F=the number of phases within the block nf.

There is now applied the restriction that the pulse phase for all locations in a given pulse placement (vector) shall be different for those vectors that have been chosen. The remainder are discarded.

All of the vectors thus obtained are considered to be encodable and are then closed loop tested, wherein the values of the phases of the "best" pulse placement relative to each of the positions of the start pulses are transferred to the receiver.

The complexity of the calculations and of the tests can be kept unchanged, by compiling and using a list of the various candidates in descending order with respect to the total phase adjustment, wherein the candidate which was "next best" in a test is examined first in the next test, and so on throughout a complete frame.

An algorithm for the aforesaid phase position adjustment is made apparent in the accompanying Appendix 2.

Figures 8A, 8B, 8C, 8D, 8E:
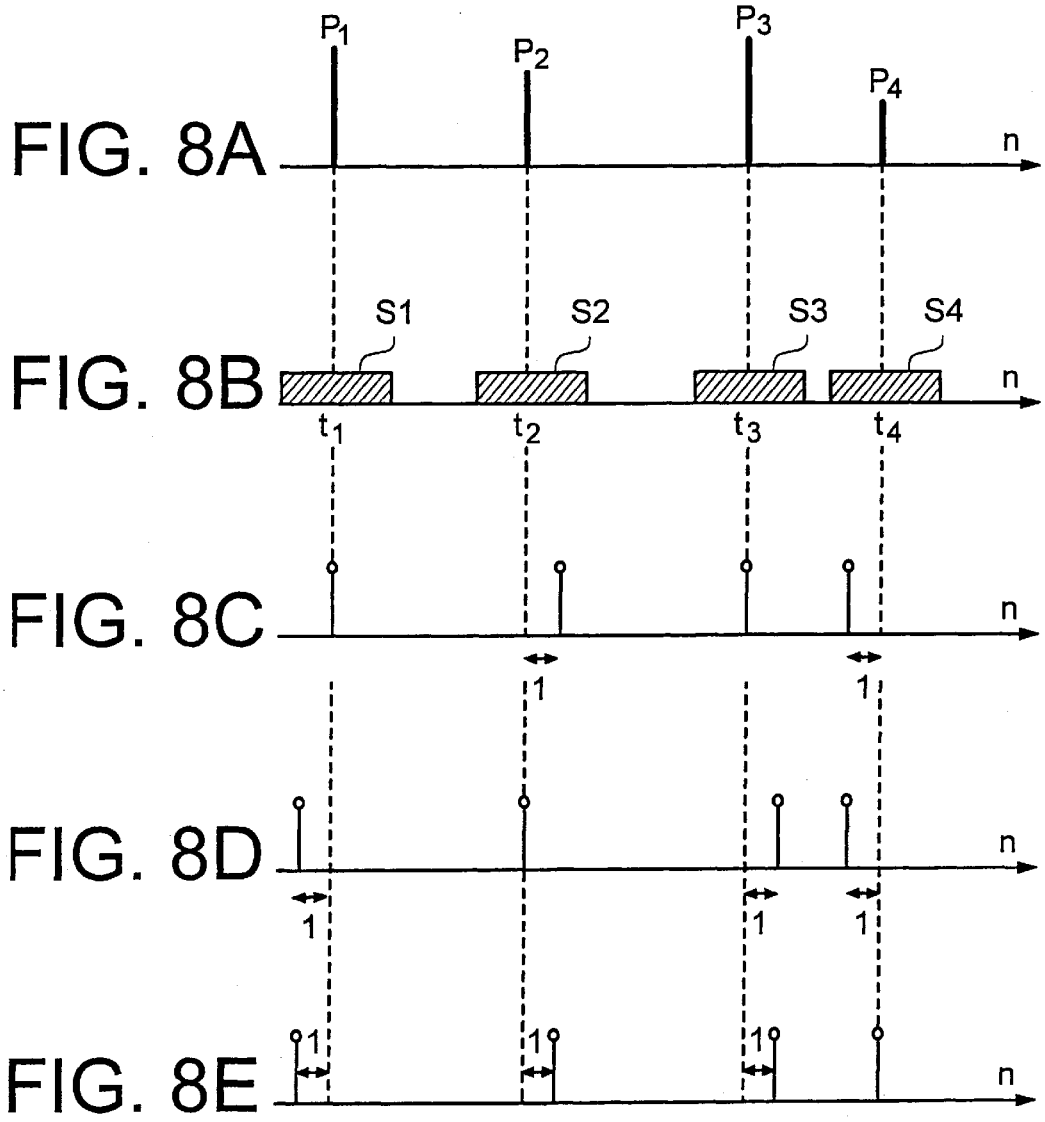
FIG. 8 is a diagram which illustrates the placement of pulses with the aid of phase position adjustment in accordance with the invention.

FIG. 8 is a diagram which illustrates the aforedescribed phase adjustment of the excitation pulses that have been obtained without restrictions in accordance with the aforegoing. FIG. 8*a*) shows those excitation pulses P1, P2, P3 and P4 that have been obtained without restrictions and which correspond to the pulses P1–P4 shown uppermost in FIG. 7.

There is defined for each start pulse P1–P4 of the total number of calculated start pulses without restrictions in a frame a search area S1, S2, S3, S4 which is comprised of a time interval around the position of the start pulse in the frame, FIG. 8*b*). Pulse positions outside each of these search areas are non-permitted pulse positions and thus constitute the restriction. A small number of permitted pulse positions are found within respective search areas. For instance, respective search areas will include the two pulse positions that are formed by those positions that lie closest to the pulse position $m_i$ that has been calculated without restrictions. Consequently, there is calculated a number of pulse placements that can be formed from these "side positions" permitted around each start pulse position.

FIG. 8*c*) illustrates a pulse placement which is calculated with the pulse P1 as the start pulse, wherein a further three pulses have been formed by virtue of two pulses, P2 and P4, having a phase deviation increment calculated from the original positions of these latter start pulses, while the third start pulse P3 has been given a phase deviation from its associated start pulse position according to the example. This results in a total phase shift =2.

With a starting point from the start pulse P2, FIG. 8*d*) illustrates how two pulses, P0 and P4, have been displaced one step to the left from their associated start pulse positions, and how the fourth pulse P1 has been displaced one step to the right. This results in a total phase shift =3.

With a starting point from the start pulse P4, FIG. 8*e*) illustrates how two pulses, P2 and P3, have been displaced one step to the right from their associated start pulse positions, and the first pulse P1 has been displaced one step to the right from its associated start pulse position. This also results in a total phase shift =3.

The following Table can therewith be compiled:

Only two start pulse positions are taken as an example, these start pulse positions having the sequence numbers 2 and 5, wherein $f_{p1}$, $f_{p2}$ below have been calculated in accordance with the relationship on page 12, line 2, with F=3.

TABLE

| | Pulse position mp | | | | | | Shift | $f_{p1}$ | $f_{p2}$ | Encodeable? |
|---|---|---|---|---|---|---|---|---|---|---|
| Start pulse position | | 2 | | | 5 | | 0 | 2 | 2 | No |
| Shifted | | 2 | | | | 6 | 1 | 2 | 3 | Yes |
| ver- | | 2 | | 4 | | | 1 | 2 | 1 | Yes |
| sion | 1 | | | | 5 | | 1 | 1 | 2 | Yes |
| of | 1 | | | | | 6 | 2 | 1 | 3 | Yes |
| start | 1 | | | 4 | | | 2 | 1 | 1 | No |
| pulse | | | 3 | | 5 | | 1 | 3 | 2 | Yes |
| posi- | | | 3 | | | 6 | 2 | 3 | 3 | No |
| tions | | | 3 | 4 | | | 2 | 3 | 1 | Yes |

Generally, none of the phases fp may be equal for encodability, i.e. $f_{p1} \neq f_{p2}$. The following applies when several start pulse positions mp are used, ie $p \geqq 3$ $f_{p1} \neq f_{p2} \neq f_{p3} \neq f_{p4} \ldots$ for one and the same pulse placement.

The obtained encodable pulse placements are then mutually compared, according to "closed loop" in the aforegoing, and the phase values of the "best" codable placement are transferred. The amplitude Am of the pulses can be taken from the amplitude value of the start pulse used as a basis in respective pulse placements, or the amplitudes can be recalculated in order to take into account the phase change of respective calculated pulses.

The values of the phases fp and the phase position nfp for the "best" encodable placement are transferred.

Figure 9:
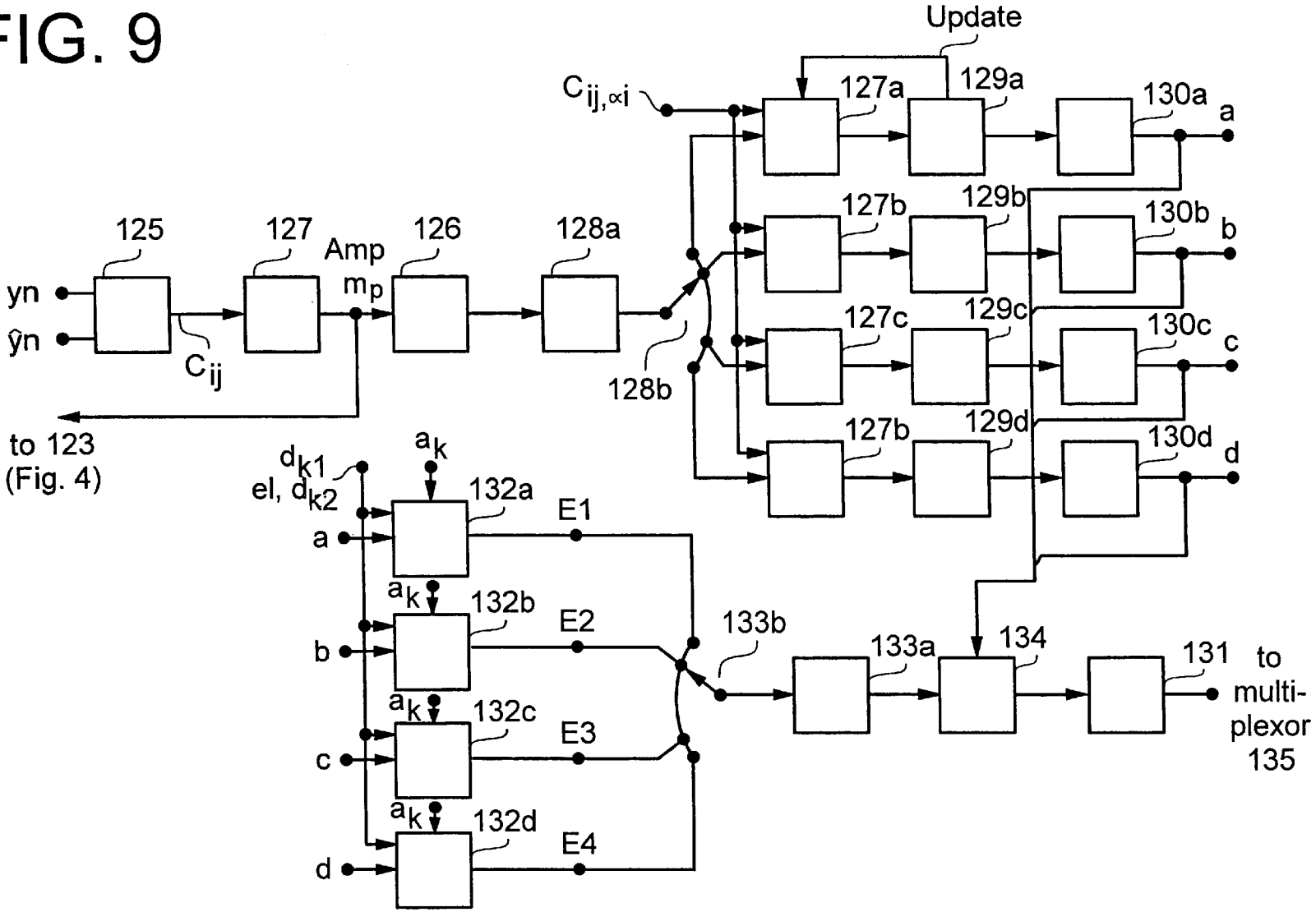
FIG. 9 is a block schematic which illustrates part of a speech encoder operating in accordance with the inventive method.

FIG. 9 is a block schematic which illustrates part of a speech encoder that uses the inventive method.

As in the FIG. 4 illustration, the block 125 represents a correlation generator which forms the magnitude $C_{iq}=(C_{ij}, \alpha_i)$ representing the correlation between the signals y and ŷ. There then follows the excitation generator 127 which selects amplitude Amp and pulse phase position mp of the excitation pulse that gave the best correlation (=least square mean error) of i candidates. A total of I correlations are carried out before determining the position and the amplitude of a given excitation pulse. In the earlier known embodiment, the excitation generator 127 is followed by a phase position generator (129, FIG. 4). In the FIG. 9 embodiment, a memory unit 126 is connected instead. This memory unit stores the amplitudes Amp and phase positions mp (p=1, . . . , j) of the selected excitation pulses that have been obtained in accordance with the method without restrictions (block 1, FIG. 6).

The memory unit 126 is followed by a selector unit which is symbolized by the block 128*a* in FIG. 9, and a controllable switch 128*b*. The selector unit 128*a* causes the switch 128*b* to seek a number of branches for connection of a given branch to the memory unit 126, such that a given position mp (p=1, . . . , j) stored in the memory unit 126 can form a start value in accordance with the aforegoing, block 2, FIG. 6.

The uppermost branch (a) shown in the Figure includes:

An excitation generator 127*a* of the same design as the excitation generator 127;

A phase generator 129*a* of the same design as the phase generator 129 in FIG. 4, and having feedback to the excitation generator 127*a* for updating, c.f. FIG. 4;

A storage unit 130*a*; and

A calculating unit 132*a* for calculating the "closed loop" error E1 in accordance with the above, and which thus has the same function as the circuit according to FIG. 5 but without a code book. Instead of the code book, there is provided a memory in whose storage positions the values of associated pulse placements a calculated with restrictions in units 127*a*, 129*a* and 130*a* can be stored. The predictive residue $d_{k2}$ is delivered to the unit 132*a* when an adaptive code book is used, or is applied otherwise to the predictive residue $d_{k1}$. The predictive parameters ak are also supplied.

Remaining branches (b), (c) and (d) include units corresponding to the units in branch (a). Thus, each branch includes units that can determine pulse positions in accordance with the method with restrictions. Each branch thus provides a pulse placement calculated with restrictions, i.e. a total of four pulse placements (c.f. FIG. 7) with restrictions are performed in accordance with FIG. 9 on the basis of four start values mp taken from the memory unit 126. The number of branches will, of course, be extended if more than four start values are to be used. Similarly, units 132*b*, 132*c* and 132*d* are provided for storing associated pulse placements from the branches (b), (c) and (d) respectively and for calculating the error "closed loop" E2, E3 and E4 respectively.

The selector unit 128*a* controls the switch contact 128*b* to the uppermost branch (a) and gives to the excitation generator 127*a* the positions mp (p=1, . . . , j) already occupied from the pulse search without restrictions (block 1, FIG. 6). The excitation generator 127*a* also receives the updated value ($C_{ij}$, $\alpha_i$) from the correlation generator subsequent to said pulse search without restrictions. The excitation generator 127*a* and the phase generator 129*a* can now carry out a pulse search with restrictions starting from a given position i, since these units know which positions are already occupied. After a given number of searches, the result obtained gives a number of excitation pulses whose amplitudes Amp and pulse positions mp are stored in the unit 130*a*. In this case, the phase $f_p$ and the phase position $n_{fp}$ are stored instead of the pulse position mp.

The selector unit 128*a* then steps forward the switch 128*b* to the excitation generator 127*b* in branch (b) and a pulse search starting from a second start value having the position m2 is commenced by the next branch (b). This search is carried out in the same way as the search carried out by branch (a) and the pulse search is thereafter extended to the branches (c) and (d) in a similar way. The same value of Cij is applied to all branches at the beginning of the pulse search, since this value is used in testing the "candidates" when searching for the best excitation pulse (with restrictions).

Upon completion of a given number of parallel stages M, all branches (a)–(d) will have calculated the amplitude and phase positions/phase position locations of their excitation pulses and stored these values in the storage unit 134. The calculating units 132*a*–132*d* then carry out their respective calculations of the error between incoming speech frames and the synthesized speech frame in accordance with the code words used and the excitation pulses taken from respective branches. The incoming speech signal is therefore applied to each of the units 132*a*–132*d*. Each of these units calculates the closed loop error and delivers the respective error value E1, E2, E3 and E4 as an output signal. It is possible to select, for instance, the square weighted error $$E = \sum_n e_w(n)^2$$

where $e_{w(n)}$ is the difference between incoming (true) speech signals and synthesized speech signals for the values y(n) and ŷ(n) within the speech frame.

The function of the calculating units 132*a*–132*d* is the same as if an adaptive code book had not been used and the error E1–E4 is calculated in the same way.

A selector unit 133*a* with associated switch contact 133*b* senses the calculated error values E1, E2, E3 and E4 of the different pulse placements and delivers these values to a storage unit 134 one at a time. The storage unit receives the values one after the other and selects and saves an incoming value when this value is a "better" value, i.e. is a smaller error E than the immediate preceding value. At the same time as the unit 134 receives the values E1–E4, the unit registers the smallest value, i.e. the "best" pulse placement. Subsequent to having thus identified the "best" pulse placement, the storage unit 134 collects the amplitude Amp, phase fp and phase position nfp values for this "best" pulse placement. These values are obtained via one of the connections to respective storage units 130*a*–130*d* and are then delivered to the encoder 131. The encoder 131 is connected to a multiplexor 135, as shown in FIG. 1.

The encoder 131 thus receives the magnitudes: amplitude Amp and phases/phase positions fp, nfp for the "best" excitation pulses compiled with restrictions. As before mentioned, the obtained phases $f_1$, . . . , $f_p$ can be coded commonly and the obtained phase positions $n_{f1}$, . . . , $n_{fp}$ coded individually prior to transmission. The essential thing is that the phase positions and the phase position locations are coded in separate message words. This improves distinctiveness and therewith reduces the error probability.

Figure 10:
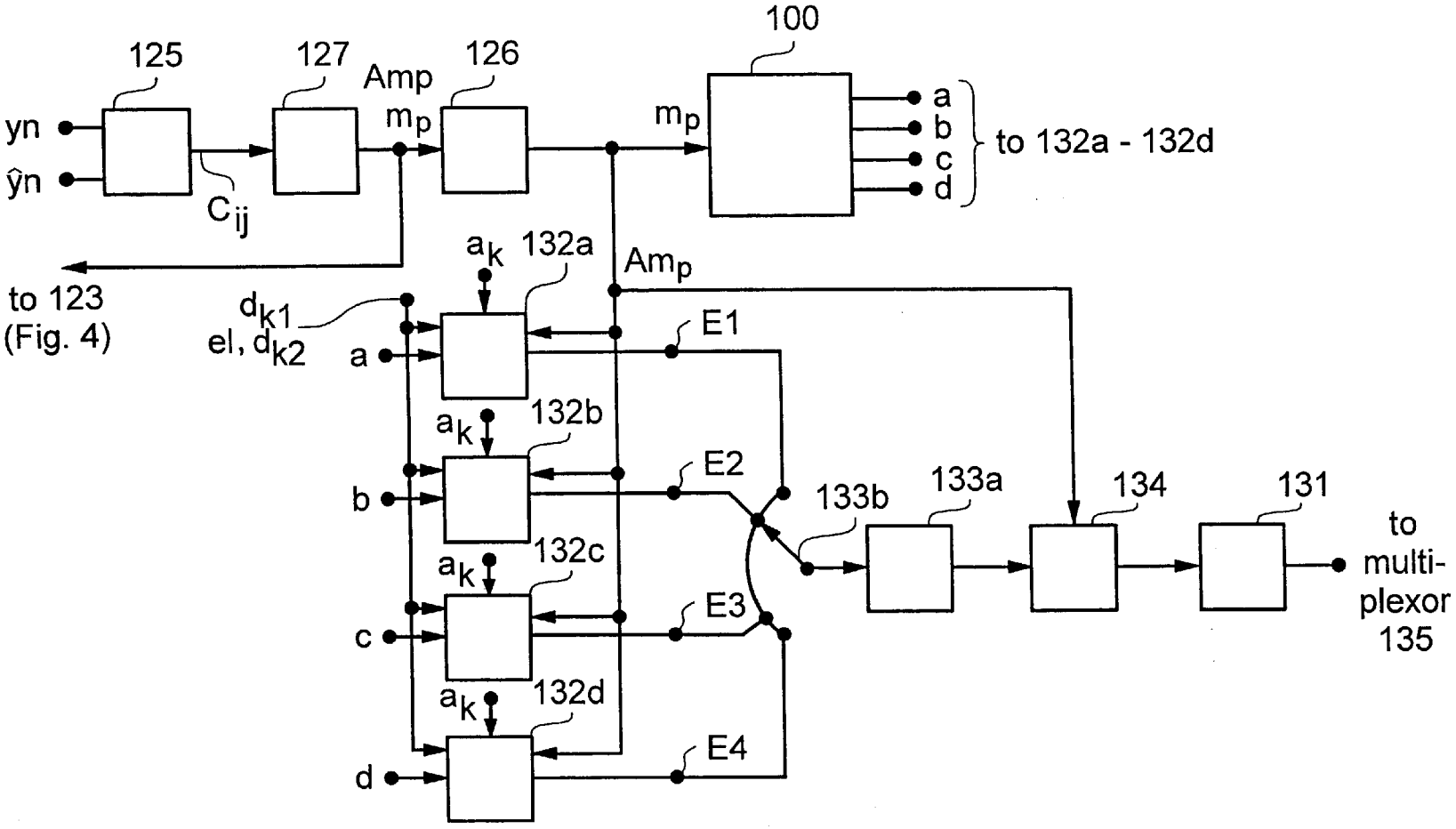
FIG. 10 is a block schematic which illustrates part of a speech encoder that operates in accordance with an alternative inventive method.

FIG. 10 is a block schematic similar to FIG. 9 but modified for making the phase adjustment to starting pulses as described above (FIG. 8). The selector 128*b* and subsequent blocks 127*a*–*d*, 129*a*–130*a*–*d* for calculating pulse positions with restrictions have been omitted and replaced instead with a unit 100 which defines the aforesaid search areas for each of the start pulses P1–P4 (FIG. 8). No excitation pulses are allowed to be placed outside this search area and consequently the introduction of the search area around each start pulse and associated calculations can be said to replace the earlier said calculation with restrictions in accordance with FIG. 9. The unit 100 also calculates the pulse positions for the possible number of pulse placements in accordance with that described above (the above Table) and compiles the possible pulse placements while taking the code restrictions into consideration. These code restrictions are thus obtained over the outputs a, b, c and d and the obtained pulse placements are then delivered to the units 132*a*–132*d* which calculate respective closed loop errors E1, E2, E3 and E4 in the manner earlier described.

Since no value of the amplitudes of the pulse placement selected for coding in the encoder 131 was delivered to the unit 100, the amplitude values Amp of each of the pulse placements are delivered from the memory unit 126 to the calculating units 132*a*–132*d* and to the storage units 134.

When coding the phase positions and the phase position locations respectively, these positions and position locations can be combined separately, in twos or in greater multiples in a message block including associated parity words in a known manner. Coding of a single word for phase position and phase position location respectively with an associated parity word can also be carried out. The advantage of having several values in a message word is that a saving is made in bandwidth, although it is then necessary to use "harsher" coding in order to obtain better protection. Although simpler coding with less protection can be applied in the latter case with only one phase value or phase position value, it will result nevertheless in a loss in bandwidth. Coding of the phases can be effected with combinatory coding.

It will be understood that FIGS. 9 and 10 merely illustrate the principle of how associated circuits of a speech encoder can be constructed. In reality, all units may be integrated in a microprocessor which is programmed to carry out the functions in accordance with the flow chart of FIG. 6 and the accompanying Appendix 1 and Appendix 2.

Speech quality can be improved by the proposed method in comparison with the known method with restrictions and lower complexity. Since both known methods with and without restrictions are used, it is possible to select the proportion between the number of calculated excitation pulses according to the methods with and without restrictions respectively and in this way obtain optimal distribution which provides the lowest calculation complexity for a given desired speech quality. The calculation complexity is greatly reduced in comparison when an extreme value calculation is made for all possible positions within a speech frame.

The inventive method has been described above in conjunction with a speech encoder in which the excitation pulses are placed in position one pulse at a time until a frame interval has been filled. EP-A 195,487 describes another type of speech encoder which operates with a pulse pattern placement procedure in which the time distance $t_a$ between the pulses is constant, instead of a single pulse. The inventive method can also be applied with such a speech encoder. In this case, the forbidden positions in a frame (c.f. FIGS. 4*a*, 4*b* above, for instance) coincide with the positions of the pulses in a pulse pattern.

Appendix 1

Algorithm for the calculating stages according to the flow chart of FIG. 6.

Modified calculation stages 1–8 are disclosed in U.S. Pat. No. 5,193,140.

U.S. Pat. No. 5,193,140 is designated [2] below. The autocorrelation matrix Φij in [2] is below designated C(i, j)=Cij in the descriptive part of the Application. The pulse positions mp and mq in [2] are designated $ms_p$ and $ms_q$ respectively in the present case. The magnitude $\alpha_i$ in [2] and in the descriptive part of the specification are here designated a(i). Analogous for $\alpha_m$ in [2] in relation to a(m) below.

| | |
|---|---|
| 1. | Calculate the desired signal y(n). |
| 2. | Calculate the cross-correlation vector a(i) and copy to asave(i). |
| 3 | Calculate the covariance (or autocorrelation) matrix C(ij). |
| 4. | For p = 1 to P + extra. |
| 4.1 | Search for $ms_p$, i.e. the pulse position which gives the maximum a(i)*a(i)/C(ij) = a(ms)*a(ms)/C(ms,ms) in the unoccupied positions. |
| 4.2 | Calculate the amplitude $A(ms_p)$ for the discovered pulse position $ms_p$. |
| 4.3 | Update the cross-correlation vector a(i). |
| 4.4 | Discard the found position $ms_p$ from the possible positions. |
| 5. | For q = 1 to P + extra. |
| 5.1 | Copy asave(i) to a(i). |

-continued

| | |
|---|---|
| 5.2 | Assign $m_1$ the value of $ms_q$. |
| 5.3 | Calculate the amplitude $A(m_1)$ for the starting pulse position $m_1$. |
| 5.4 | Update the cross-correlation vector a(i). |
| 5.5 | For p = 2 to P. |
| 5.5.1 | Search for $m_p$, i.e. the pulse position which gives maximum a(i)*a(i)/C(ij) = a(m)*a(m)/C(m,m) in the unoccupied phases. |
| 5.5.2 | Calculate the amplitude $A(m_p)$ for the discovered pulse position $m_p$. |
| 5.5.3 | Update the cross-correlation vector a(i). |
| 5.5.4 | Exclude the positions with the same phase as $m_p$. |
| 5.6 | Calculate closed-loop error E. |
| 5.7 | If the error E is lower than the error for the previously saved set of positions and amplitudes, save the positions $m_p$ as $mw_p$ and the amplitudes $A(m_p)$ as $A(mw_p)$. |
| 6. | Calculate $f_p$ and $n_{fp}$ in accordance with the relationship (1) in [2] for the saved (winning) set of positions $mw_p$. |

Appendix 2

Algorithm for phase position adjustment.

Designations according to Appendix 1.

| | |
|---|---|
| 1. | Calculate the optimal positions $ms_p$ and amplitudes $A(ms_p)$ as in step 1 through 4 in the previous section. (Appendix 1). |
| 2. | Construct the n = ((P + extra) over P) combinations of P positions out of the $ms_p$ optimal positions. |
| 3.0 | For $combination_i$ = $combination_1$ to $combination_n$. |
| 3.1 | Shake all positions in $combination_1$ around by shifting each position one step in each direction. If the resulting set of positions are encodable using the restricted positioning code, save them in a list min_shift_list with an ordering in respect to the total phase shift from the unshifted $combination_i$. |
| 4.0 | For j = 1 to nb_to_test. |
| 4.1 | Copy the positions at the top of the min_shift_list to $mv_p$. |
| 4.2 | Remove the top positions in the list min_shift_list. |
| 4.3 | Copy the amplitudes from $A(ms_p)$ of the corresponding unshifted $combination_i$ to $A(mv_p)$. |
| 4.4 | Calculate closed-loop error Ej, using $mv_p$ and $A(mv_p)$. |
| 4.5 | If the error Ej is lower than the error for the previously saved set of positions and amplitudes, save the positions $mv_p$ as $mw_p$ and the amplitudes $A(mv_p)$ as $A(mw_p)$. |
| 5. | Calculate $f_p$ and $n_{fp}$ in accordance with the relationship (1) in [2] for the saved (winning) set of positions $mw_p$. |

What is claimed is:

1. A method of encoding excitation pulse parameters of a first and second kind which commonly give the positions of the excitation pulses calculated by a) calculating the positions of the excitation pulses in a plurality of calculation stages in accordance with a first method in which a speech signal divided into speech frames is analyzed and the analyzed speech signal is synthesized to form a prediction residue and a plurality of predictive parameters which are applied to an excitation processor which filters the prediction residue and the parameters obtained from the excitation processor for each of the desired excitation pulses in accordance with said predictive parameters, b) performing a plurality of calculation stages to determine the positions of the excitation pulses each with a starting point from one of a plurality of positions calculated in accordance with the first method, in accordance with a second method in which a speech frame is also divided into a plurality of phase positions and each phase position is divided into a plurality of phases, wherein restrictions are inserted which prohibit the phase that is occupied when placing an excitation pulse to each subsequent excitation pulse and to each phase position within the speech frame, so as to obtain one of a plurality of pulse placements; and c) selecting the proportion between the number of calculation stages according to the first and the second method respectively so as to obtain the least calculation complexity for a certain given speech quality, and combining the parameters of the first kind in one or more message words which are separate from message words that contain parameters of the second kind, and encoding each of these latter message words separately.

2. A method according to claim 1, certain of said message words contain two or more of solely the one kind of said parameters and a parity word for encoding the message word in a known manner.

3. A method according to claim 1, certain of said message words contain solely one of said parameters and one parity word for encoding the message word in a known manner but with softer coding than when several parameters of the same kind are included in the message word.

* * * * *